US005515905A

United States Patent [19]

Lester

[11] Patent Number: 5,515,905

[45] Date of Patent: May 14, 1996

[54] AUTOMATIC HORIZONTAL PRESSURE DIE INJECTION SYSTEM

[76] Inventor: William M. Lester, 651 W. Mt. Pleasant Ave., Livingston, N.J. 07039

[21] Appl. No.: 183,261

[22] Filed: Jan. 19, 1994

Related U.S. Application Data

[63] Continuation of Ser. No. 977,160, Nov. 16, 1992, abandoned.

[51] Int. Cl.[6] ..... B22D 17/10; B22D 17/32

[52] U.S. Cl. ..... 164/313; 164/155.4

[58] Field of Search ..... 164/113, 313, 164/457, 155, 150

[56] References Cited

U.S. PATENT DOCUMENTS 2,972,172 2/1961 Federman .
4,354,545 10/1982 Goldhammer .
4,428,413 1/1984 Lester .

*Primary Examiner*—Kuang Y. Lin

[57] ABSTRACT

Horizontally movable mold halves respectively journal different plungers for movement within coaxial bores extending through the closed mold halves. With the mold closed, and one plunger extending through the mold to one side, a metered compartment is formed between the two carefully positioned plungers. A charge of molten metal, or the like, is transferred from a reservoir into the compartment and moved into the mold cavity by moving the two plungers in unison to a position at the die surface of the respective mold halves. After hardening, the mold halves are separated and one plunger ejects the molded article from the mold. The plungers and mold halves are moved by hydraulic cylinder rams into a sequence of fixed positions for different steps of a programmable molding cycle. Sensing switches provide feedback for establishing the plunger positions at various cycle steps. In particular a variable movable sensing switch establishes the capacity of the molten metal metered compartment to produce a charge precisely tailored for the mold cavity.

1 Claim, 2 Drawing Sheets

AUTOMATIC HORIZONTAL PRESSURE DIE INJECTION SYSTEM

This application is a continuation of application Ser. No. 07/977,160, filed Nov. 16, 1992, now abandoned.

TECHNICAL FIELD

This invention relates to pressure die casting systems and methods, and more particularly it relates to simplified automated systems for controlling pressurized injection of precisely metered molten charges into horizontal molds during a sequence of steps of a molding cycle.

BACKGROUND ART

In the die casting industry, charges of molten metal are in general loaded into a die casting machine by ladling a charge large enough to assure that the molds are completely filled. Accordingly significant waste of metal and excess heating energy is incurred by overloading dies with molten metal charges. Yet the possibility of incompletely filled molds and resulting defective molded parts requires that the die be overloaded for each casting cycle. Thus, it is desirable to improve the state of this art by precisely metering into the die-casting machine just enough molten metal for each charge to assure quality castings.

I have previously introduced machines for metering charges into dies with high accuracy as disclosed in my U.S. Pat. No. 4,428,413, Jan. 31, 1984: HIGH ACCURACY INJECTOR FOR DIE CASTING MACHINES AFFORDING AUTOMATIC METAL LEVEL COMPENSATION. However these machines meter a precise quantity of charge from a molten metal reservoir in a manner not particularly suited for use with the pressure die casting process with horizontal dies actuated by moving die halves into mating registration for molding and separating them for ejection. Typical prior art for such systems is disclosed in U.S. Pat. No. 4,354,545, W. M. Goldhammer, Oct. 19, 1982 for MODIFIED PRESSURE CASTING PROCESS.

It is particularly advantageous in these systems to use the pressure die-casting mode thereby speeding up the cycle time and compacting the charge to remove residual gases. However, prior art horizontal mold systems have inherently required ladling the charge of molten metal, thus introducing waste of metal and energy. Furthermore processing time, cost and inconvenience is encompassed in handling and removing residual overflow "biscuits" inherent in the prior art systems.

Typical of pressure die casting systems is U.S. Pat. No. 2,972,172, A. P. Federman, Feb. 21, 1961 for METHOD FOR FEEDING LIQUID CASTING MATERIAL INTO AN ARTICLE MOLD. This vertical die casting machine, leaves a residual overflow biscuit in the feeding system that must be processed and contributes to metal and energy waste.

There is no known automated pressure die casting system operable with horizontal die casting machines for adjustably metering out precisely measured molten metal charges that avoid waste and yet assure completely filled dies.

It is accordingly an objective of this invention to provide for improved and automated metering of charges in pressure die casting systems for horizontal die casting machines.

Further objects, features and advantages of the invention will be found throughout the following description, drawings and claims.

DISCLOSURE OF THE INVENTION

Methods of pressure die casting and coacting novel and simplified horizontal die casting machines are afforded by this invention to provide for precisely metered molten metal charges avoiding waste and fast automated or semi-automated molding cycles. Thus, two horizontally movable mold sections mate to form a mold cavity and separate to eject a molded part. With the dies in mated position, a pair of coaxially related plungers, one extended through one mold half and into the other, form a metering cavity coupled with a molten metal reservoir at the start of a molding cycle. The two plungers are positioned and retained at scheduled positions defining the volume of a metering chamber for receiving a molten metal charge. A metering plunger variably positionable by means of a movable position sensor thus exactly and precisely determines a stopping position of the metering plunger and thereby the precise magnitude of the charge. A simple adjustment may be made for different die capacities or during operation to respectively avoid either the chance for unfilled die cavities or any significant waste of overflow metal and the energy taken to melt it.

To achieve these advantages, the two plungers are coaxially aligned and journalled in a cylindrical cavity extending through the respective die halves for independent movement by means of respective hydraulic rams in a series of timed steps in a molding cycle. Thus, an automated cyclic timing system or equivalent manual operation steps the system through a series of programmed plunger positions during the casting cycle, which is completed by opening die halves to eject the molded article and initiated with the die halves closed to form the molding cavity. Plunger positions are simply detected at various operational steps by sensing switches for automated feedback control during the molding cycle.

Thus, to start the molding cycle after the mold halves are closed, the plungers are individually positioned and held in place for metering out the precise molten metal charge from a molten metal reservoir into a metering compartment defined by the plungers. The plungers are then simultaneously moved to carry the charge into the mold in the pressure casting mode, with a reaction plunger freely moving up to a scheduled stop at the face of one die surface. The injection plunger forces the charge into the mold until it reaches the mold face. After the metal freezes, the mold halves are opened, the molded article is ejected by the reaction plunger, and the dies are closed to initiate a further molding cycle. The steps are fully or semi-automated by a programmable cyclic timing system responding to feedback switches, or the like, that indicate the positions of the respective plungers.

BRIEF DESCRIPTION OF THE DRAWINGS

In the accompanying drawings, wherein like reference characters refer to similar features throughout to facilitate comparison.

THE PREFERRED EMBODIMENT

Figure 1:
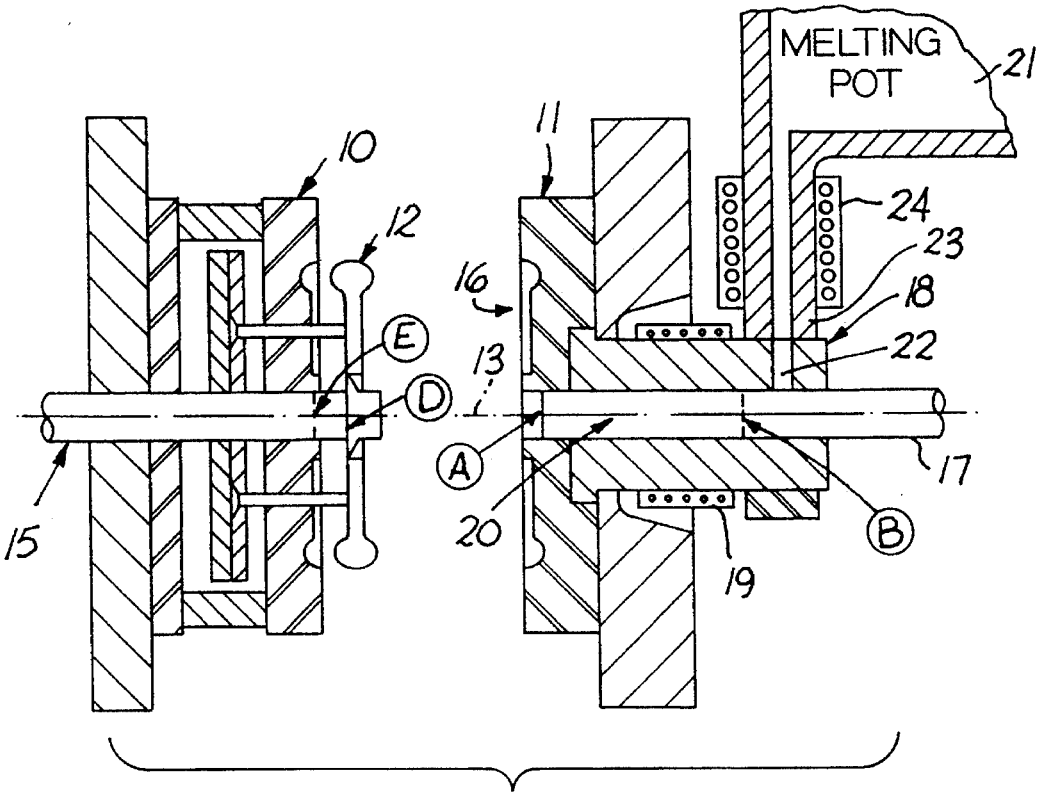
FIG. 1 is a fragmental side view, in section, of a horizontal die casting machine embodiment of the invention with the die halves separated for ejecting a molded article.

The injection molding system of this invention is embodied in a horizontal die casting machine in the FIG. 1 embodiment. A pair of relatively movable mold sections 10, 11, is shown in the open position with the molded article 12 being ejected from the movable mold member 11 by means of movable reactor plunger 15. The reactor plunger 15 is journalled to move through the movable mold section 10 along the axis 13 and into the fixed mold section 11 in coaxial alignment along axis 13 with the injection plunger 17 at the start of a new molding cycle.

Figure 2:
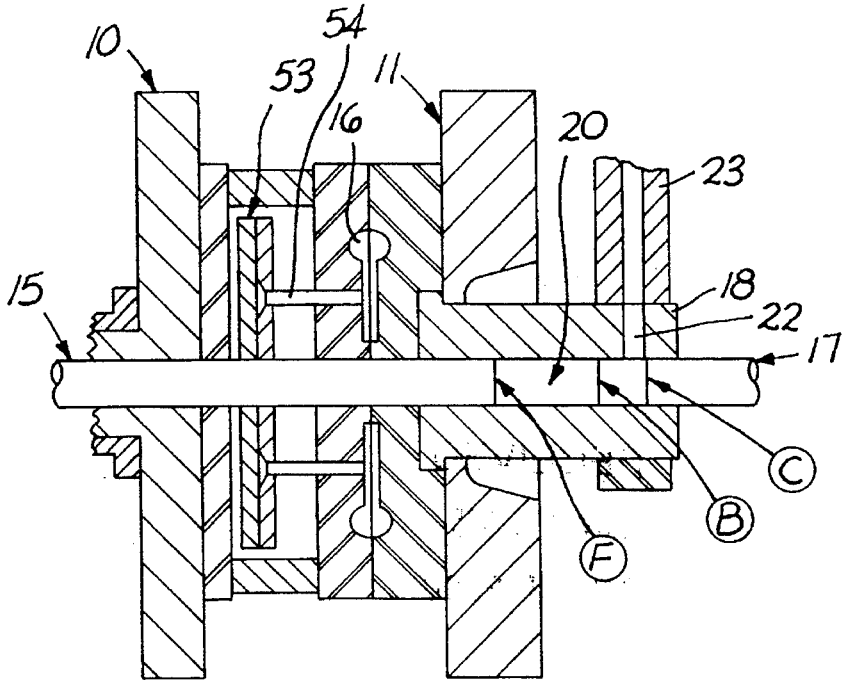
FIG. 2 is a corresponding side view, in section, with the die halves mated in molding position to form a molding cavity in readiness for initiation of a molding cycle.

Injection plunger 17 is journalled in cylinder 18, located in the fixed mold section 11 and heated by coil 19 for retaining molten metal charges transferred into the metering cavity 20 in molten condition. Melting pot 21 is coupled via channel 22 and hollow stem 23 heated by coil 24 for introducing molten metal into the metering cavity 20 when the channel 22 is unplugged by movement of the injection plunger 17 to position C, as seen in FIG. 2 after the movable mold members 10 and 11 are closed to form the molding cavity 16.

As shown, the plungers 15 and 17 are in coaxial alignment, with reactor plunger 15 extending through both die halves 10, 11 and into cylinder 18 to a restrained limit position forming a fixed end barrier F for the metering cavity 20. At the start of the molding cycle the rest position of injector plunger 17 after closing of the mold and before the filling of the metering cavity 20 is at B thereby blocking the molten material from melting pot 21 until the molding cycle is initiated.

At the start of the molding cycle then the injection plunger is moved back to C to open passageway 22 and fill the metering cavity 20. The amount of molten metal in metering cavity 20, as established by reactor plunger position B is adjusted to assure that the mold cavity 16 and associated runners are filled without forcing any substantial excessive waste material out. As later shown in detail, the stop position of the reaction plunger 15 at F is variably adjustable so that the system will accommodate different mold cavity volumes and can be adjusted during operation to "fine tune" the operating efficiency of the die casting machine.

Stationary mold member 11 carries the molten metal injection mechanism, and a hydraulic ram system provides on injection plunger 17 the force for the pressure die casting injection of the charge of molten metal in metering cavity 20 into mold cavity 16 as the plunger 17 is moved (right to left) into limit position A. By control of the accompanying hydraulic system for operating the reaction plunger 15 during this pressure die casting step that plunger 15 is permitted to freely follow the movement of plunger 17 and intermediate charge of molten metal in cavity 20 until it reaches position E and is held stationary there at the face of the mold. The charge then moves into and fills mold cavity 16, Until the injection plunger 17 reaches stop position A at the mold surface.

After the metal freezes, the mold sections 10 and 11 are separated an the reaction plunger 15 and ejector plate 53 and ejector pins 54 are moved simultaneously to position D to eject the molded article 12 from the mold section 10 for removal from the die. The mold sections are then moved together and mated to form the mold cavity 16 for starting a new molding cycle.

Figure 3:
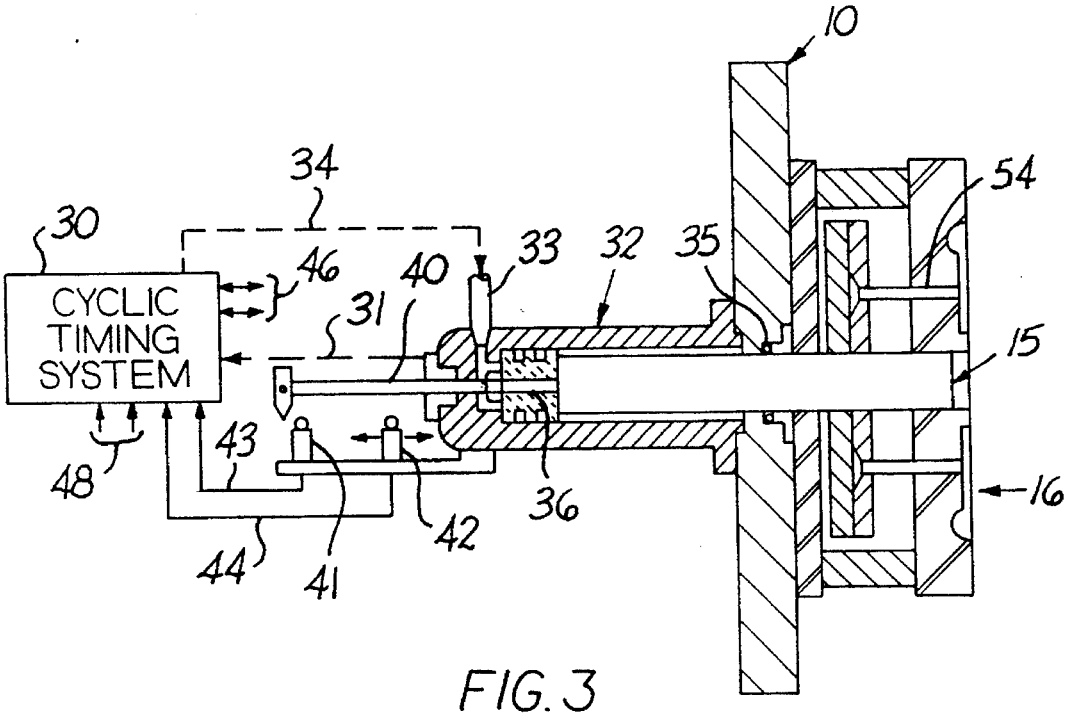
FIG. 3 is a side view fragment, partly in section, with accompanying block diagram, illustrating sensing switches for establishing the position of the plunger.

As shown in FIG. 3, the cyclic timing system 30 operates a hydraulic ram or equivalent to move section 10 for closing and opening the mold, as schematically indicated by dotted line 31. Hydraulic cylinder 32 is supplied with hydraulic fluid at input line 33 in a timed relationship indicated schematically by dotted line 34 for positioning, floating and stopping the reactor plunger 15 in accordance with the molding cycle timing sequence. Conventional hydraulic seals 35, 36 are respectively provided about the plunger 15 in the journalling path and to mate with the cylinder 32 walls.

For positioning and timing the positioning of the reactor plunger 15, and providing feedback signals to the cyclic timing system 30 the rod 40, movable with reactor plunger 15, operates the E limit switch 41 and F limit switch 42 for providing hydraulic system signals for stopping the plunger 15 in place respectively to eject the molded article and set the capacity of the metering chamber 20, as seen in FIGS. 1 and 2. The switch feedback signals to the cyclic timing system 30 are indicated at lines 43, 44. Note the arrows at the charge magnitude adjusting switch 42, indicating variable positioning to change charge magnitudes for different molds and for vernier adjustments to adjust the charge at optimized positions during the operating cycles for avoiding waste without endangering unfilled molds resulting in defective molded products.

Lines 46, 48 at the cyclic timing system 30 represent other timed output control functions and input signals for automatically or semi-automatically putting into effect the operating cycle hereinbefore described, or desirable variations thereof.

Figure 4:
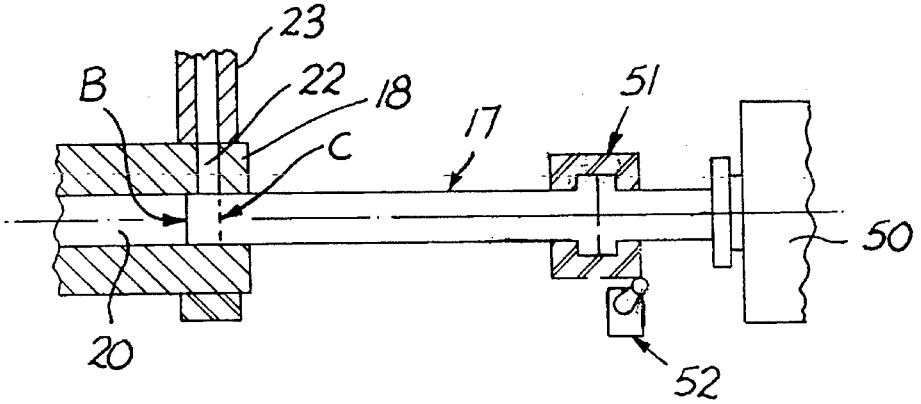
FIG. 4 is a fragmental side view, partly in section, of a hydraulic ram drive coupled to the injection plunger for a pressure die casting shot of molten material into the die.

In FIG. 4, the hydraulic cylinder-ram 50 is coupled at joint 51 for moving the injection plunger 17 through a pressure die-casting cycle in accordance with the requirements aforesaid of the molding cycle. Thus, at the start of the cycle, the injection plunger is moved from its ready rest position B past entry channel 22 for the molten metal to position C thus permitting molten metal to flow into the metering chamber 20 by gravity or force feed to introduce a cyclic charge. Limit switch 52, for example, stops the injection plunger 17 at limiting position B to await the start of the molding cycle.

There is thus provided by the invention an injection molding system having the following interacting elements:

(1) a set of movable mold members 10, 11 and mold movement ram 31 for forming therewith a mold cavity in a mated position of the mold members and apparatus 53, 54 for ejecting a molded body in a separated position of the mold members;

(2) injection control plunger 17 and mating journalling cylinder 18 defining an injection plunger movement cavity 20 extending into one of the mold members 11;

(3) reactor control plunger 15 (fifteen) and mating journal defining a reactor plunger movement cavity extending through the mold member 10 and the mold cavity 16 to coaxially merge the injection plunger movement cavity 20;

(4) a source of molten material 21 is coupled to the injection control plunger movement cavity 20 for movement of a charge of molten material into the injection plunger movement cavity 20 in readiness for injection into the mold cavity 16 in response to movement of the injection control plunger 17;

(5) programmable positioning structure for controlling the position of the injection control plunger in said injection plunger movement cavity;

(6) programmable positioning structure for controlling the position of the reactor plunger in the reactor plunger movement cavity;

(7) position sensing switches 41, 42, 52 for determining at least one position of the respective injection control and reaction plunger 15, 17 in their respective cavities;

(8) feedback control system coupled from the position sensing structure to the programmable positioning structure for arresting movement of the respective plungers at metering positions defining a metering compartment in the injection plunger movement cavity in response to the position sensing structure during a molding cycle; and (9) metering channel 22 and plunger 17 for apportioning molten material charges of predetermined magnitude from the melting pot 21 into the metering compartment 20 in response to the arrested movement of the two plungers 15, 17 at selected metering positions.

The interaction between the foregoing clauses of the preceding paragraph and the cyclic timing system to produce the molding cycles is set forth in the preceding text.

It is thus seen that this invention provides a novel method of molding articles in the pressure die-casting mode with horizontal dies which is simple, reliable, efficient and subject to automation. Novel equipment in the die casting machine includes horizontal dies are provided with coaxial reactor and injector plungers aligned to pass through the respective die sections and into the mold chamber for attaining a sequence of operating positions during the molding cycle. The pressure die-casting power is attained in the preferred embodiment from a hydraulic ram, which is programmable for the various sequential operating steps of the molding cycle. The reactor plunger moves into the fixed mold section to comprise variably controllable metering means for precisely forming a charge of just enough molten material to form the molded article without excess waste. This, simple, effective system has improved the state of the art, and the novel features indicative of the spirit and nature of the invention are defined with particularity in the following claims.

I claim:

1. An injection molding system comprising in combination, a pair of movable mold members and mold movement means for forming therewith a mold cavity in a mated position of the mold members and for ejecting a molded body in a separated position of the mold members, an injection control plunger and mating journalling means defining an injection plunger movement cavity extending into one of the mold members, a reactor control plunger and mating journalling means defining a reactor plunger movement cavity extending through the other of the mold members and through the mold cavity to coaxially merge with said injection plunger movement cavity for forming a compartment between said plungers, a source of molten material coupled to the compartment formed between the plungers for movement of a charge of molten material into said compartment in readiness for injection into the mold cavity in response to movement of the injection control plunger, programmable positioning means for controlling the position of the injection control plunger in said injection plunger movement cavity for injection of the charge of molten material, programmable positioning means for controlling the position of the reactor plunger in said reactor plunger movement cavity for receiving the charge and ejecting a molded body, position sensing means for determining at least one position of the respective injection control and reaction plungers in their respective cavities to receive said charge of molten material, feedback control means coupled between the position sensing means and the programmable positioning means responsive to the position sensing means for arresting movement of the respective plungers at metering positions defining a metering compartment between the plungers in response to said position sensing means during a molding cycle, metering means for apportioning molten material charges of predetermined magnitude from said source into the metering compartment in response to the arrested movement of the two plungers at said metering positions, and a cyclic timing system for programming a sequence of molding steps by positioning said injection control and reaction plungers and movable mold members into different positions of a molding cycle for receiving the metered charges of molten materials, moving the charge into said mold cavity, ejecting said molded body and repositioning the plungers for a new cycle.

* * * * *